US006386006B1

(12) United States Patent
DeWalch

(10) Patent No.: US 6,386,006 B1
(45) **Date of Patent: *May 14, 2002**

(54) ROTATION RESTRICTED BARREL LOCK AND KEY

(75) Inventor: Norman Binz DeWalch, Houston, TX (US)

(73) Assignee: Dewalch Technologies, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/301,516

(22) Filed: Sep. 7, 1994

Related U.S. Application Data

(63) Continuation-in-part of application No. 08/053,589, filed on Apr. 27, 1993, now abandoned.

(51) Int. Cl.[7] ..... E05B 19/00; E05B 67/36

(52) U.S. Cl. ..... 70/34; 70/395; 70/397; 70/398; 70/404; 70/454

(58) Field of Search ..... 70/34, 454, 404, 70/388, 395, 397, 398, 414, 386, 407, 408, 403, 496, 389, 491, 420, 429, 453

(56) References Cited

U.S. PATENT DOCUMENTS

| | | | | | |
|---|---|---|---|---|---|
| 729,773 | A | * | 6/1903 | Katz et al. | 70/395 |
| 975,122 | A | * | 11/1910 | Crabtree | 70/395 |
| 2,690,070 | A | * | 9/1954 | Spain | 70/496 X |
| 3,363,440 | A | * | 1/1968 | Rivers | 70/414 |
| 3,421,349 | A | * | 1/1969 | St. Clair, Jr. | 70/414 |
| 3,446,045 | A | * | 5/1969 | Finck, Jr. | 70/34 |
| 3,903,720 | A | * | 9/1975 | Scherbing | 70/454 X |
| 4,018,069 | A | * | 4/1977 | Lipschutz | 70/395 |
| 4,100,777 | A | * | 7/1978 | Fredon | 70/398 X |
| 4,313,319 | A | * | 2/1982 | Haus, Jr. et al. | 70/347 X |
| 4,366,688 | A | * | 1/1983 | Bennett | 70/395 |
| 4,446,709 | A | * | 5/1984 | Steinbach | 70/496 |
| 4,637,234 | A | * | 1/1987 | Mielonen | 70/34 |
| 5,440,909 | A | * | 8/1995 | Ely et al. | 70/408 X |
| 5,542,273 | A | * | 8/1996 | Bednarz | 70/386 X |

FOREIGN PATENT DOCUMENTS

| | | | | |
|---|---|---|---|---|
| CH | 474653 | * | 8/1969 | 70/34 |
| DE | 375138 | * | 5/1923 | 70/395 |
| DE | 633936 | * | 8/1936 | 70/398 |
| FR | 2225995 | * | 11/1974 | 70/395 |
| GB | 1069072 | * | 5/1967 | 70/414 |

* cited by examiner

*Primary Examiner*—Lloyd A. Gall
(74) *Attorney, Agent, or Firm*—H. Artoush Ohanian; Arnold & Associates

(57) ABSTRACT

A rotation restricted barrel lock and key includes a rotationally actuated barrel lock and a key for opening the lock. The key comprises a lock engaging portion rigidly attached to a handle, and a sleeve rotatably mounted on the handle shaft. The sleeve may slide axially along the shaft within preset limits. Lock actuation is characterized by rotation of the lock engaging portion of the key relative to the lock. During actuation of the lock, a set of prongs on the sleeve engages a complementary set of notches on the barrel lock, thereby non-rotatably coupling the barrel lock to the sleeve. By grasping the sleeve, the user can prevent rotation of the lock while turning the key handle, and thus actuate the lock.

10 Claims, 9 Drawing Sheets

ROTATION RESTRICTED BARREL LOCK AND KEY

RELATED INVENTIONS

This application is a continuation in part of application Ser. No. 08/053,589, which was filed Apr. 27, 1993, now abandoned.

BACKGROUND

1. Field of the Invention

This invention relates to barrel locks, specifically to means for inducing relative rotation between a barrel lock and a key.

2. Problems Addressed by the Invention

Barrel locks are used to secure meter rings like the one shown in U.S. Pat. No. 4,702,093 (DeWalch, 1987), as well as a variety of other locking hardware. In the present disclosure, the term "locking hardware" is used to refer to any device which is secured by a barrel lock. A barrel lock, as defined in the present disclosure, is commonly characterized as having a generally cylindrical case with a head portion, a smaller diameter shank portion, and a shoulder portion interposed between the head and shank portions. The shank portion includes retaining means, usually a pair of retractable steel balls, to prevent extraction of the lock from the meter ring or other locking hardware when the lock is locked. Usually barrel locks are removed from the locking hardware when they are unlocked. In many cases removal of the lock is required for opening the locking hardware.

Many barrel locks, such as the one described in U.S. Pat. No. 4,289,000 (Nielsen, 1981), rely on axial movement of the key to actuate the lock. Although the operation of axially actuated locks is independent of lock rotation, these locks have a relatively small number of possible key codes, are often easy to pick, and require the use of a rather large and cumbersome key. To overcome these difficulties, barrel locks have been developed which are actuated by rotation of the key relative to the lock. In the present disclosure, this type of lock will be referred to as a "rotationally actuated barrel lock".

The generally cylindrical shape of most barrel locks allows them to rotate freely within the locking hardware. Although rotationally actuated barrel locks have many advantages, their rotation within the locking hardware can potentially cause a problem during lock actuation. Whenever the torque required to unlock the lock is greater than the torque required to rotate the lock within the locking hardware, the entire lock will rotate with the key. Since no relative rotation occurs between the lock and the key, the lock remains locked. In this situation, the user is clearly in need of some means to induce the relative rotation of the lock and key.

3. Discussion of Prior Art

In order to provide background information so that the present invention may be completely understood in its proper context, reference is made to the following articles of prior art. The first article of prior art comprises an O-ring installed on the smaller diameter shank portion of the barrel lock, abutting the shoulder formed at the transition to the larger diameter head portion. When the barrel lock is locked or unlocked, the user applies an axial force on the lock via the key. The O-ring is compressed between the shoulder on the lock case and an internal shoulder in the locking hardware, creating a frictional force to inhibit rotation of the barrel lock. This approach is unreliable, due to its dependence on the condition of the O-ring, the presence of moisture, dirt or oil, and other factors which affect the frictional characteristics of the component surfaces.

A second method for inducing relative rotation of the barrel lock and key involves the user grasping a portion of the lock itself, to keep it from rotating while the key is turned. In order for this method to be used, some portion of the lock must be made accessible to the user. This is usually accomplished either by designing the locking hardware so that it does not completely cover the lock, or by elongating a portion of the lock so that it extends beyond the locking hardware, as shown in Swiss Pat. No. 474,653. However, whenever the lock grasping method is used, the exposed portion of the lock makes the whole system more susceptible to tampering and vandalism. For this reason, it is common for the entire lock case to be completely shielded and protected by the locking hardware, thereby denying the user access to the lock.

A third article of prior art is the set screw shown in U.S. Pat. No. 5,085,063 (Van Dyke, et al., 1992). Although the set screw prevents rotation of the lock within the locking hardware, it also prevents axial movement of the lock, thus making it difficult and time consuming to remove the lock from the locking hardware. Since lock removal is necessary for proper hardware operation in many barrel lock applications, the usefulness of the set screw alternative is limited.

Whatever the precise merits, features, and advantages of the above cited articles of prior art, they do not achieve or fulfill the purposes and objects of the present invention as set forth below.

SUMMARY OF THE INVENTION

Objects of the Invention

Accordingly, several objects and advantages of the present invention are:

(a) to provide a means for inducing the relative rotation of a barrel lock and key, in particular when the lock is substantially encased by the locking hardware.

(b) to provide a means for inducing the relative rotation of a barrel lock and key which allows for easy removal of the lock from the locking hardware.

(c) to provide a means for inducing the relative rotation of a barrel lock and key which will operate reliably.

Other and further objects, advantages and features of the present invention will become apparent from a consideration of the following discussions and drawings describing various embodiments of the invention.

Brief Physical Description

The preferred embodiment includes a rotationally actuated barrel lock, a key for opening the lock, and a generally cylindrical sleeve rotatably mounted about the key. The sleeve is also free to slide axially along the key within preset limits. Lock actuation is characterized by rotation of the key relative to the lock. During actuation of the lock, a set of prongs on the sleeve engages a complementary set of notches on the barrel lock, thereby non-rotatably coupling the barrel lock to the sleeve. By grasping the sleeve, the user can prevent rotation of the sleeve and the lock while turning the key, and thus actuate the lock.

Present Invention Vs. Prior Art

The present invention is more reliable than the O-ring of the prior art, because the interlocking means used to couple the barrel lock to the sleeve operates independently of frictional forces. The O-ring of the prior art relies entirely on friction to prevent rotation of the lock, and is therefore dependent upon the condition of the O-ring and the presence of surface contaminants. The present invention is an improvement over the lock grasping method of the prior art in that the present invention does not require any portion of the lock to extend beyond the locking hardware, where it would be vulnerable to tampering and vandalism. The present invention is also a more desirable alternative than the set screw of the prior art because the present invention allows for complete and easy removal of the lock from the locking hardware. The set screw of the prior art prevents any axial movement of the lock, and thus hinders easy removal of the lock.

How the Invention Fulfills the Objects

The present invention provides a means for inducing the relative rotation of a barrel lock and key when the key is turned. This means comprises a sleeve rotatably mounted on the key. This sleeve non-rotatably couples the lock via complementary prongs and notches on the sleeve and the lock, respectively. The user can easily prevent the lock from rotating by holding the sleeve stationary when the key is turned. Because the notches are on the top of the lock, the present invention can be used even when the lock is encased on all sides by the locking hardware. Furthermore, the present invention does not prevent axial movement of the lock, and therefore allows for easy removal of the lock from the locking hardware.

DETAILED DESCRIPTION OF PREFERRED EMBODIMENT

Figure 1:
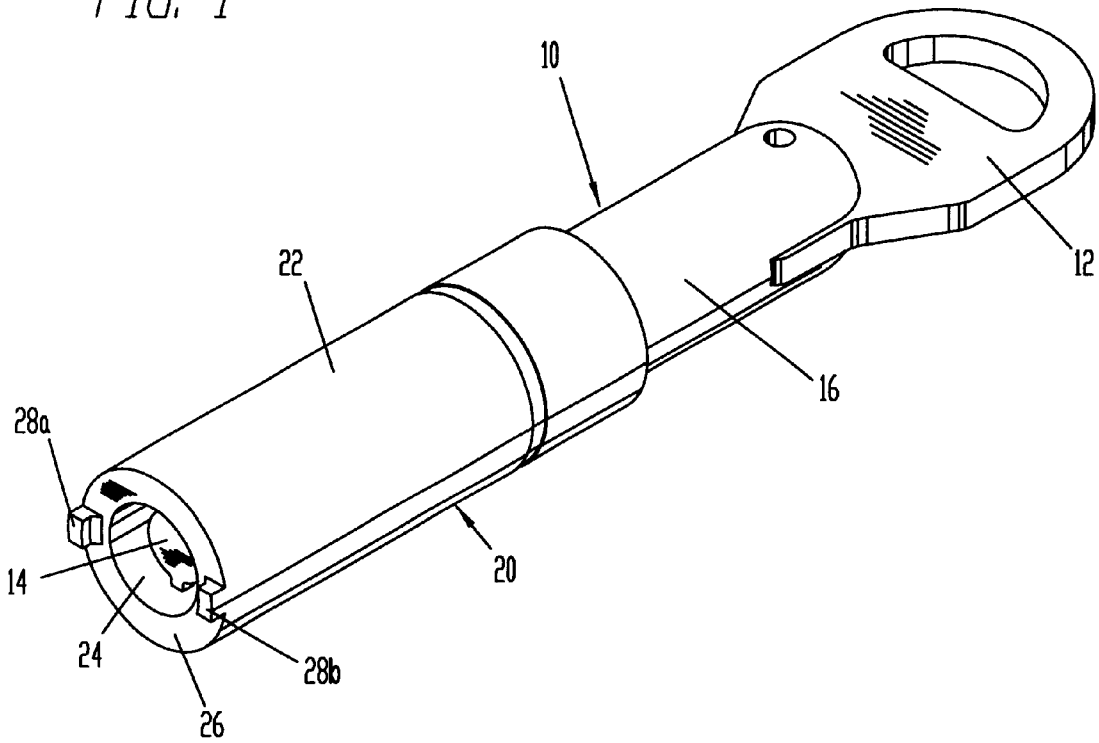
FIG. 1 shows an isometric view of the preferred embodiment key.
Figure 2:
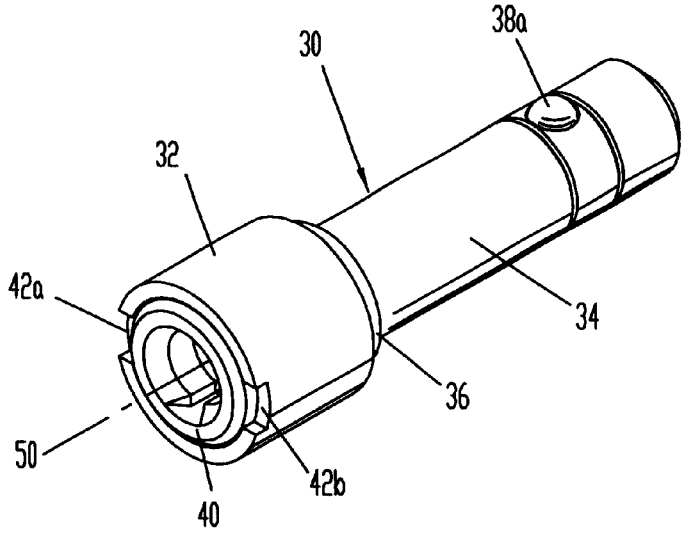
FIG. 2 shows an isometric view of the preferred embodiment barrel lock.

Referring to FIG. 1, the preferred embodiment key 10 comprises a handle 12 at one end, heretofore referred to as the top end; and a lock actuating portion or bit assembly 14 at the bottom end. The handle and bit assembly are each rigidly attached to the shaft 16. The lock coupling member or sleeve 20 is slidably and rotatably attached to the shaft 16, and comprises an outer wall 22, a central cavity 24, and an interlocking surface 26 with prongs 28*a* and 28*b*. Referring to FIG. 2, the preferred embodiment barrel lock 30 comprises a head portion 32, a smaller diameter shank portion 34, and a shoulder portion 36 between the head and shank portions. Extensible steel balls such as 38*a* serve to retain the barrel lock 30 in its locking hardware. At the end of the head portion 32 is the key receiving face 40, which includes notches 42*a* and 42*b*.

Figure 3:
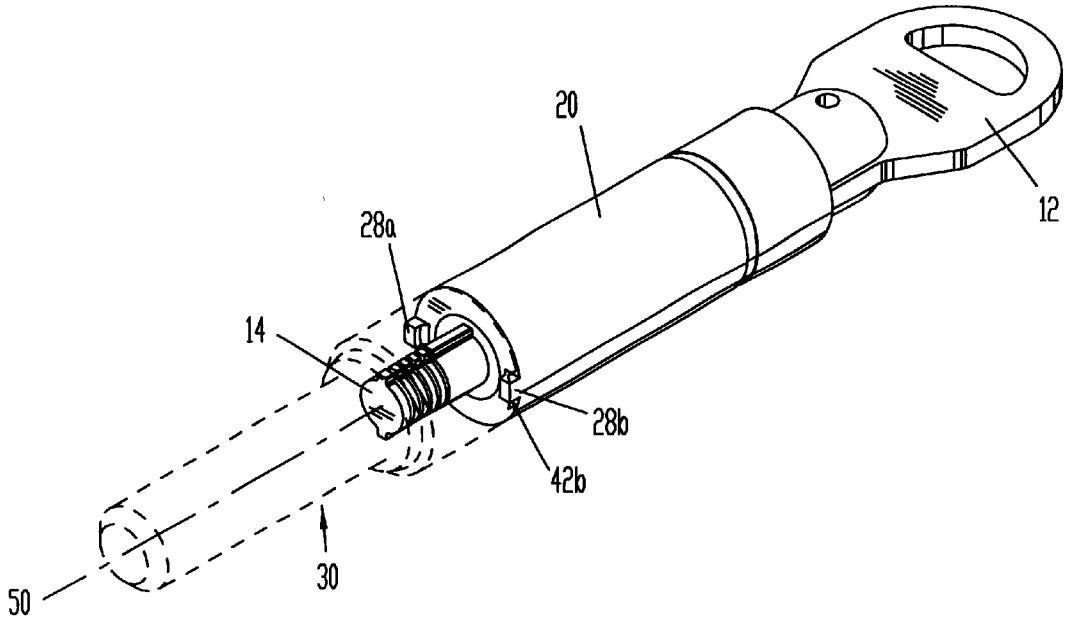
FIG. 3 shows an isometric view of the preferred embodiment key in use.

As shown in FIG. 3, when the key 10 is used to actuate the barrel lock 30, the sleeve 20 slides towards the top end of the key, exposing the bit assembly 14. As the bit assembly is inserted into the lock, the prongs 28*a* and 28*b* enter the notches 42*a* and 42*b*, respectively, and the sleeve 20 is thereby non-rotatably coupled to the lock 30. The user can now hold the sleeve and lock stationary while rotating the handle 12, shaft 16, and bit assembly 14 about the central axis 50, and actuate the lock. In other embodiments, any suitable shaped means could be used to non-rotatably couple the barrel lock and sleeve.

Figure 4:
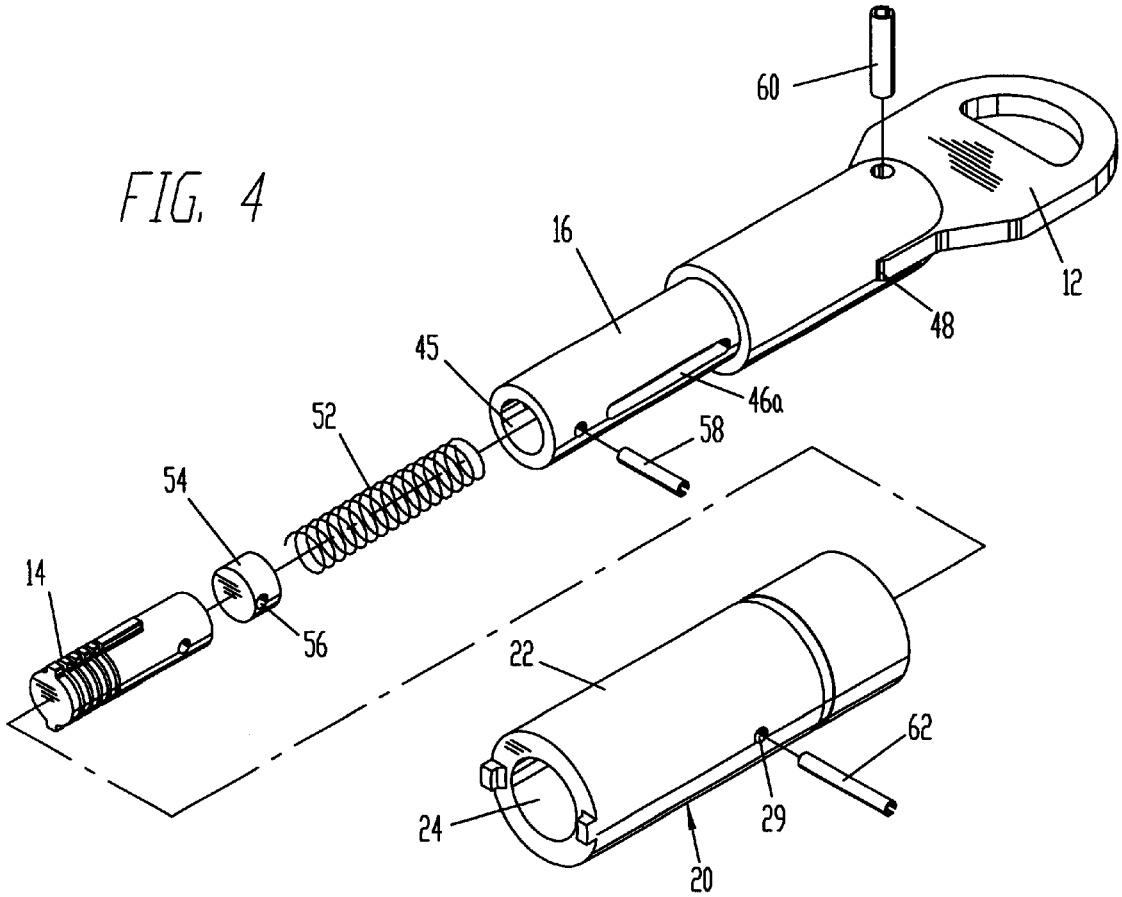
FIG. 4 shows an exploded isometric view of the preferred embodiment key.
Figure 5:
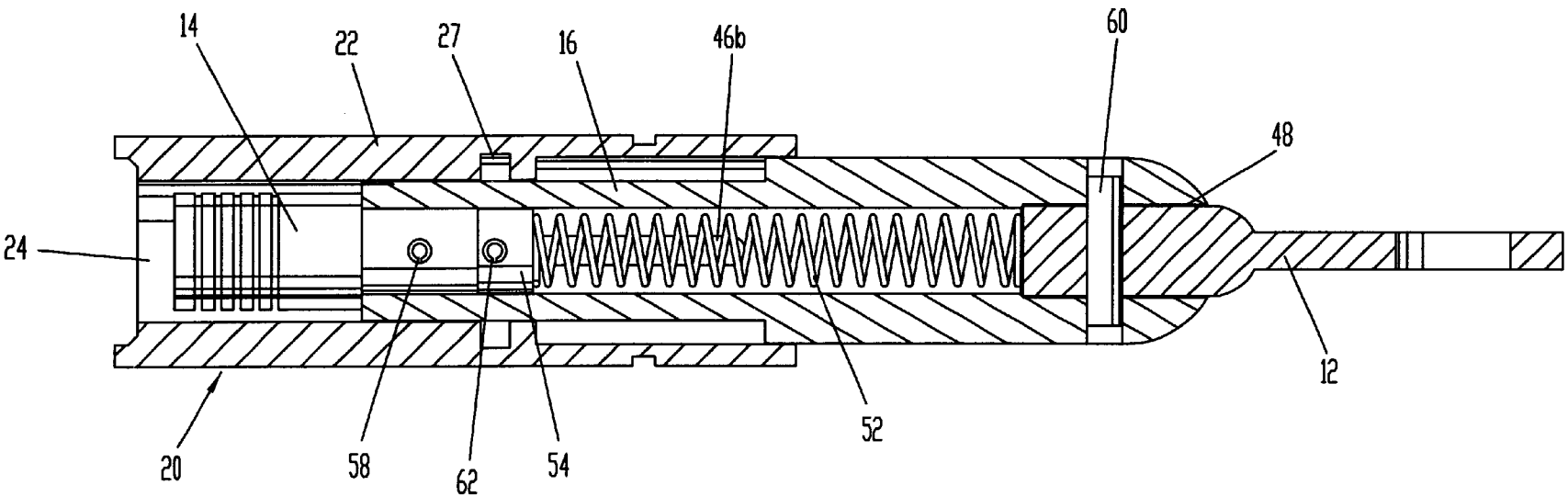
FIG. 5 shows a plane cross-sectional view of the preferred embodiment key.

Referring to FIGS. 4 and 5, the shaft 16 has a central bore 45 at its bottom end and two slots 46*a* and 46*b* on opposite sides of the sidewall 47 surrounding the central bore. When the key 10 is assembled, spring 52 and sliding plug 54 with cross hole 56 are inserted into the central bore 45. The bit assembly 14 is then pressed into the bore and held in place by roll pin 58, and the handle 12 is inserted into the slot 48 and held in place by roll pin 60. Referring to FIG. 4, the shaft 16 is then inserted into the sleeve 20 until the two opposing cross holes such as 29 in the sleeve align with the cross hole 56 in the sliding plug 54 through the slots 46*a* and 46*b*. The roll pin 62, which is longer than the diameter of the shaft 16, is then inserted through the aligned apertures to secure the sleeve 20 to the key 10. Referring to FIG. 5, the internal groove 27 in the sleeve is axially aligned with the two opposing cross holes such as 29, and has an inner diameter greater than the length of the roll pin 62. The ends of the roll pin 62 are captured by the groove 27, such that relative axial movement of the sleeve 20 and the plug 54 is prevented, while free rotation of the sleeve 20 is allowed. The axial movement of the sleeve 20 is now limited by the slots 46*a* and 46*b* in the shank 16. The spring 52 serves to bias the sleeve position towards the bottom of the key 10, in order to ensure proper engagement of the prongs 28*a* and 28*b*. In other embodiments, the sliding plug 54 could be omitted and the roll pin 62 alone could be used.

Alternative Embodiments

Figure 8:
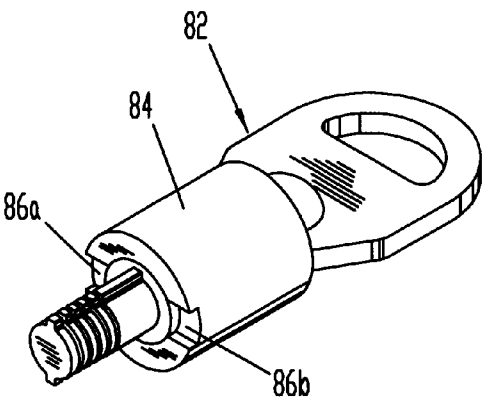
FIG. 8 shows an isometric view of an alternative embodiment key having a non-slidable, notched sleeve.
Figure 9:
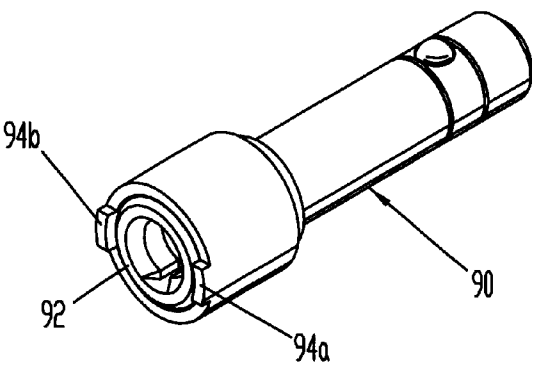
FIG. 9 shows an isometric view of an alternative embodiment barrel lock having prongs on the key receiving face.
Figure 6:
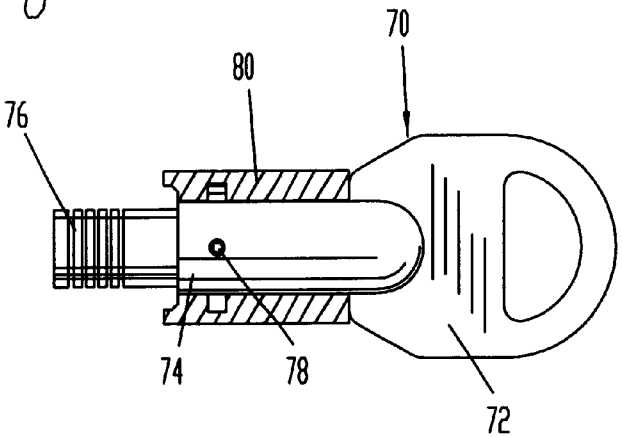
FIG. 6 shows a plane cross-sectional view of an alternative embodiment key having a non-slidable, pronged sleeve.
Figure 7:
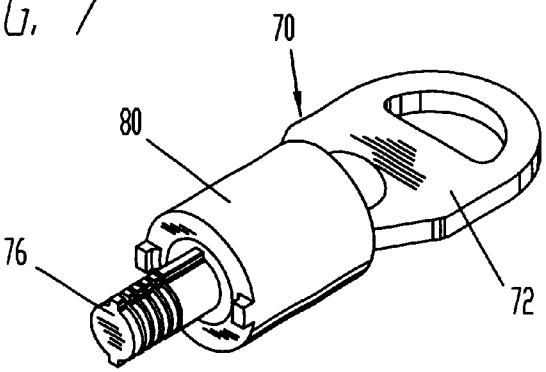
FIG. 7 shows an isometric view of the key shown in FIG. 6.

FIGS. 6 and 7 show an alternative embodiment key 70 in which the axial position of the sleeve 80 is fixed. The handle 72, shaft 74, and bit assembly 76 have been constructed as a single unit, and the stationary roll pin 78 serves to retain the sleeve 80. FIG. 8 also shows a fixed sleeve embodiment key 82; and FIG. 9 shows a barrel lock 90 openable by this key. In this embodiment the shaped means on the key receiving face 92 of the barrel lock 90 comprise prongs 94*a* and 94*b*, and the corresponding shaped means on the sleeve 84 comprise notches 86*a* and 86*b*.

Figure 10:
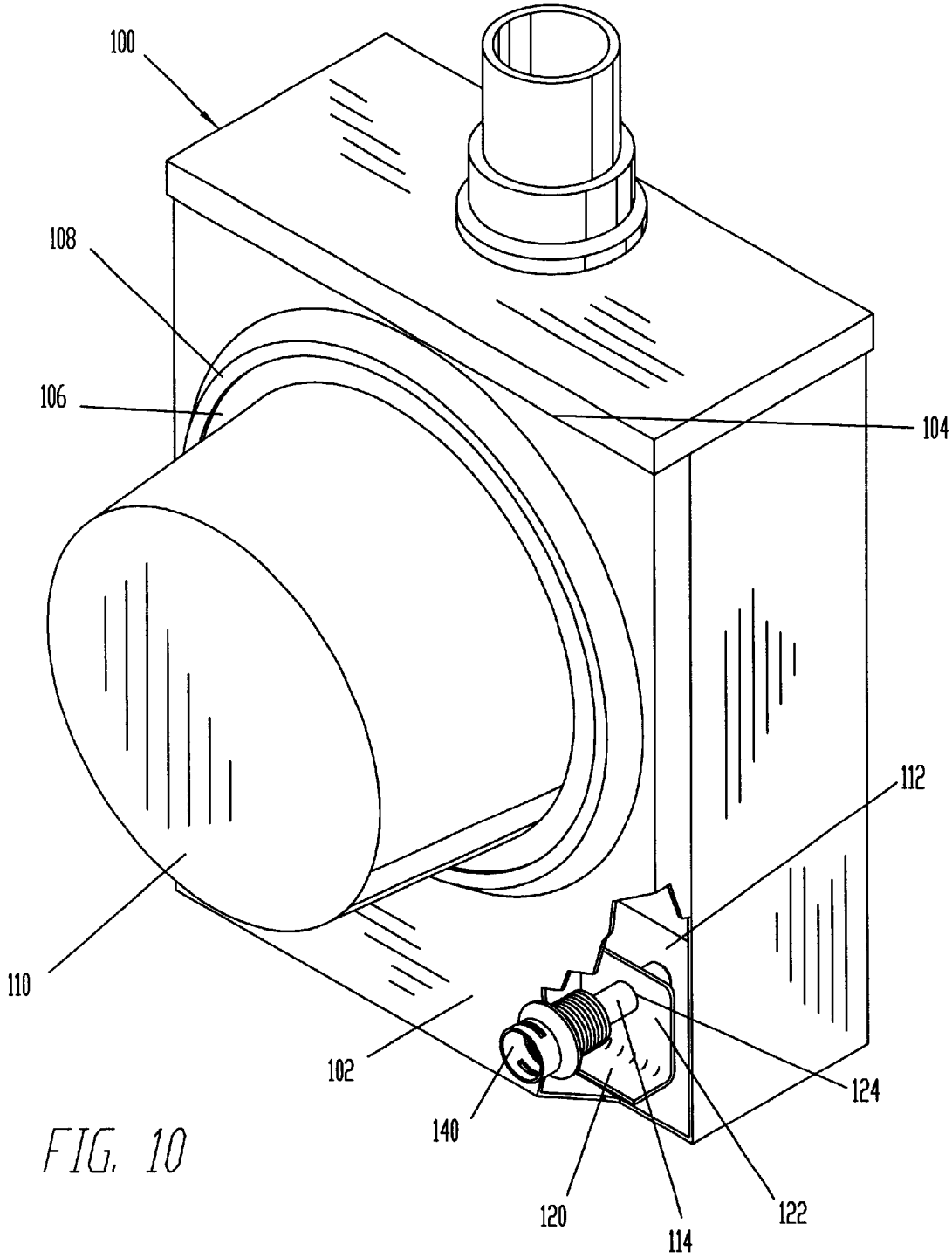
FIG. 10 shows an isometric view of the spring clip and flatted lock embodiment installed in a meter box.
Figure 11:
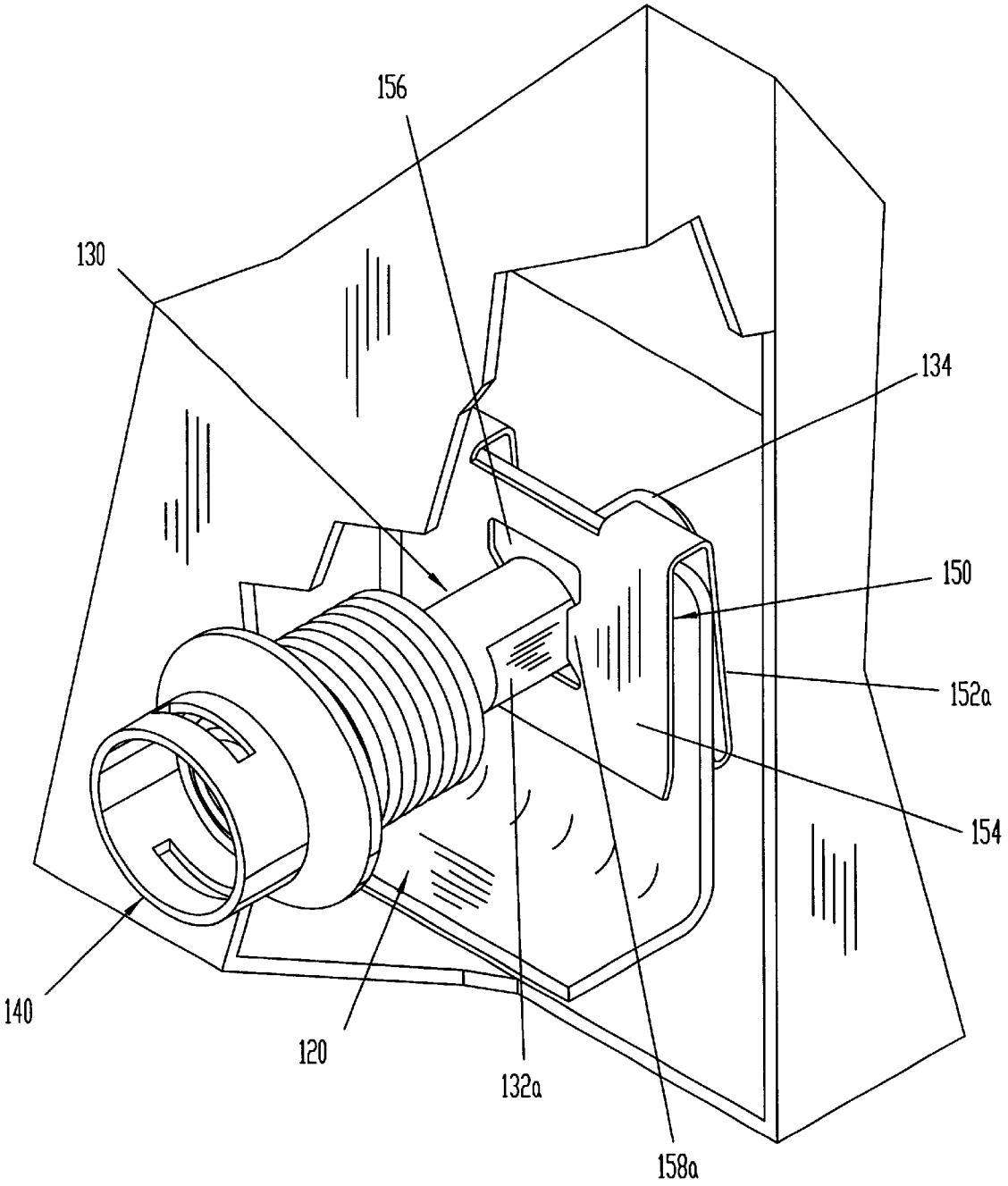
FIG. 11 shows an isometric closeup view of the embodiment shown in FIG. 10.

FIGS. 10 and 11 show an alternative method for preventing the rotation of a rotationally actuated barrel lock. FIG. 10 shows a meter box 100 of the type commonly used in the utility industry. The door 102 of the box 100 is hinged generally at 104 and includes a central hole 106 with a surrounding boss 108 which serves to retain the meter 110. The bracket 120 is welded to the floor 112 of the box and includes a flat portion 122 with a lock receiving aperture 124 therethrough. The door 102 is usually secured with a barrel lock 114, which is inserted into the threaded flange 140 until the locking balls extend beyond the aperture 124 in the bracket 120.

Figure 12:
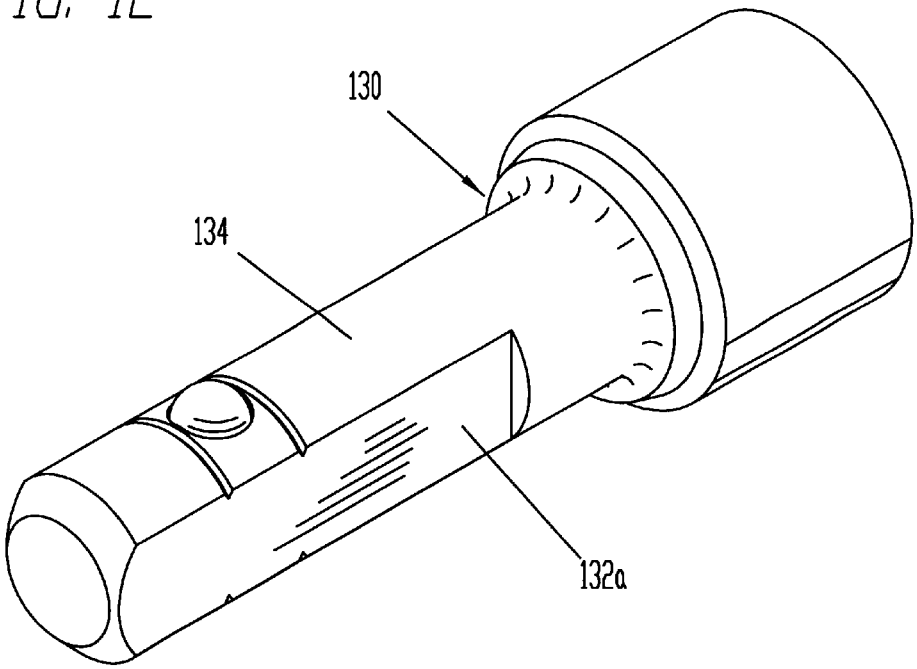
FIG. 12 shows an isometric view of an alternative embodiment lock having flats on the shank.
Figure 13:
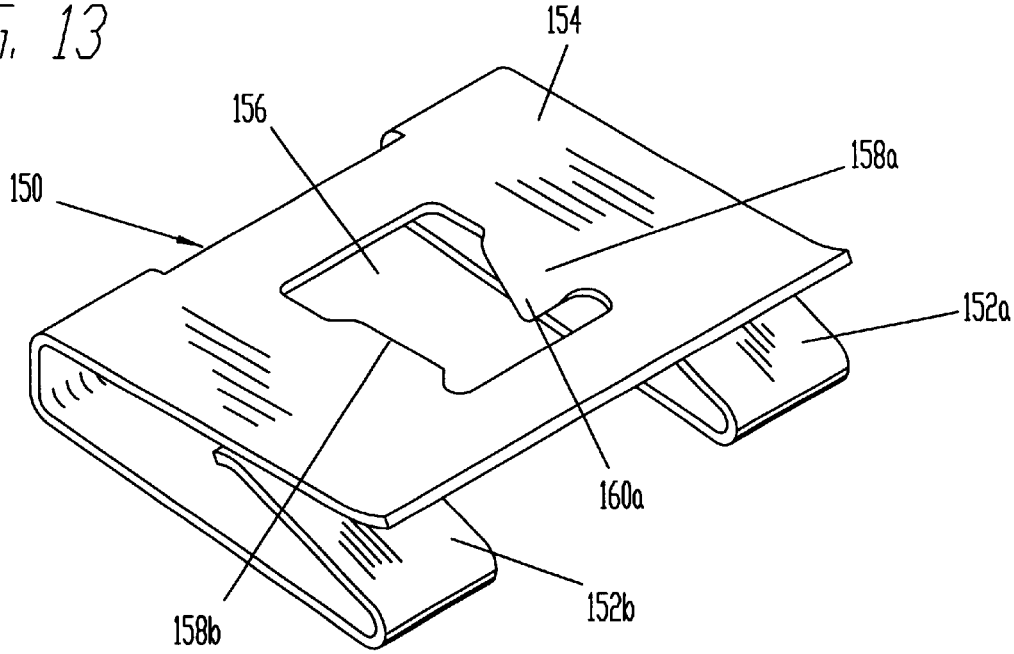
FIG. 13 shows an isometric view of the spring clip.
Figure 14:
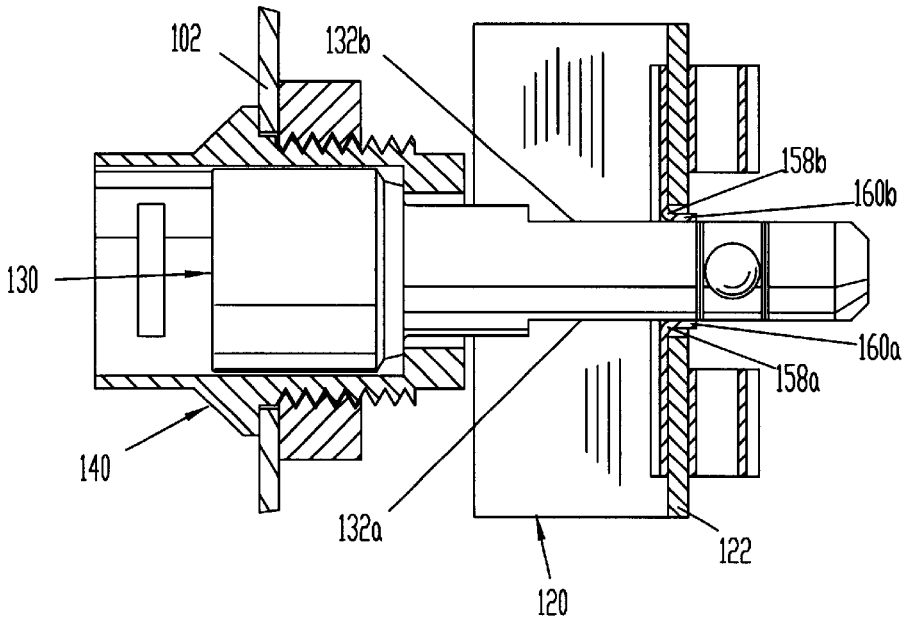
FIG. 14 shows an assembled cross-sectional view of the embodiment shown in FIG. 10.
Figure 15:
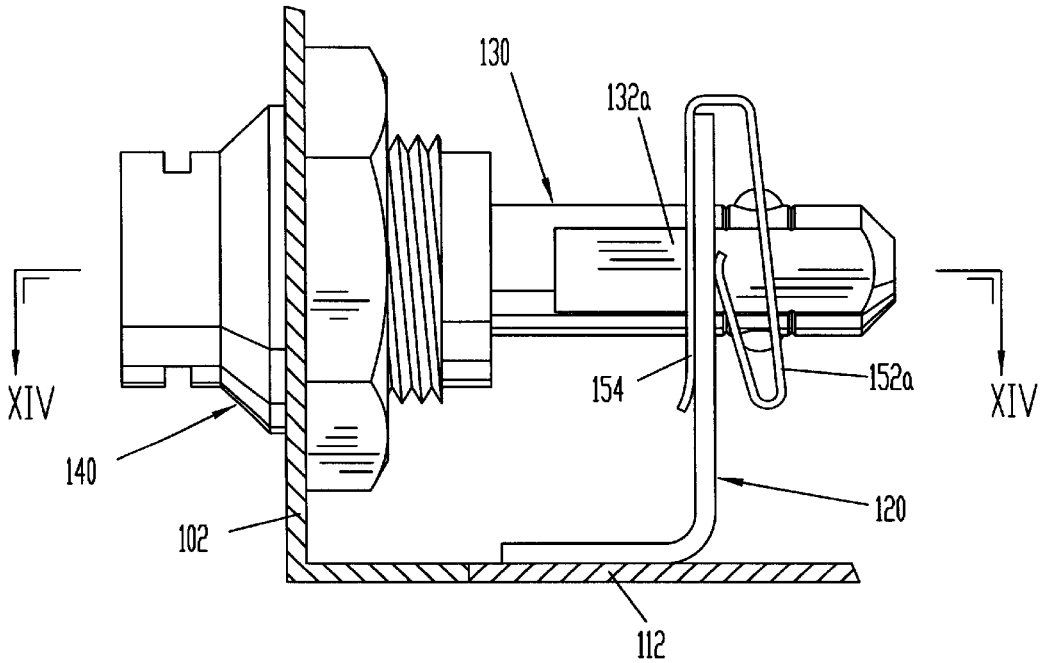
FIG. 15 shows an assembled side view of the embodiment shown in FIG. 10.

Referring to FIGS. 11 through 13, the present embodiment includes a modified lock 130 with two opposing flats such as 132*a* on the shank 134, and a spring clip 150 which is retrofitted onto the bracket 120. The spring clip 150 includes two flat spring portions 152*a* and 152*b*, and a flat plate portion 154 with a lock receiving opening 156 therein. Adjacent to the lock receiving opening 156 are two protrusions 158*a* and 158*b*, which include bent portions 160*a* and 160*b*, as shown in FIGS. 13 and 14. Referring to FIGS. 14 and 15, when the spring clip 150 is installed onto the bracket 120, the bent portions 160*a* and 160*b* extend into the lock receiving aperture 124 in the bracket 120. The flat spring portions 152*a* and 152*b* serve to maintain pressure between the flat plate portion 154 of the spring clip and the bracket, so that the bent portions 160*a* and 160*b* are retained in the aperture 124 and serve to secure the spring clip to the bracket. The protrusions 158*a* and 158*b* are sized and positioned to engage the flats 132*a* and 132*b*, respectively, on the shank 134 of the lock 130, and prevent rotation of the the lock. In other embodiments, the original bracket could be constructed with a non-circular hole designed to engage the flats or other suitable shapes on the lock.

Figure 16:
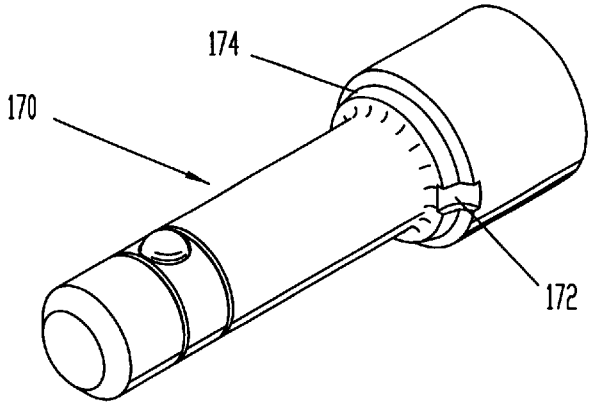
FIG. 16 shows an isometric view of an alternative embodiment barrel lock having a notch on the shoulder.
Figure 17:
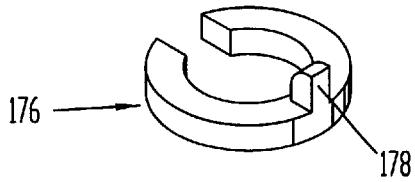
FIG. 17 shows an isometric view of the pronged split bushing.
Figure 18:
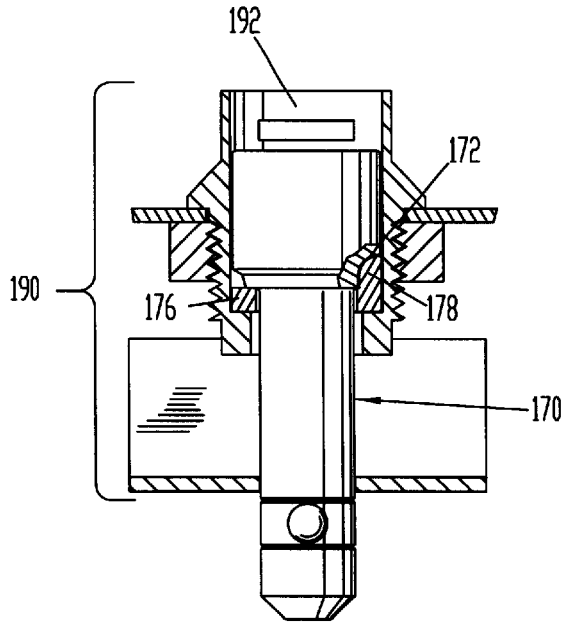
FIG. 18 shows a plane cross-sectional view of the split bushing installed in locking hardware.
Figure 19:
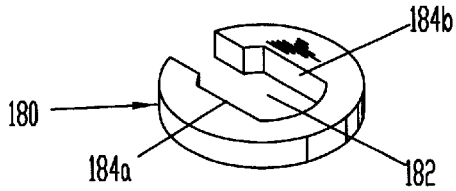
FIG. 19 shows an isometric view of the split bushing with flats.

FIGS. 16 and 17 show another alternative method for preventing the rotation of rotationally actuated barrel locks. The barrel lock 170 shown in FIG. 16 has a notch 172 in the shoulder portion 174. FIG. 17 shows a split bushing 176, with a prong 178 designed to engage the notch 172 in the barrel lock 170. Referring to FIG. 18, the bushing 176 is pressed or otherwise non-rotatably installed in the lock receiving portion 192 of the locking hardware 190 prior to insertion of the lock 170. When the lock is inserted, the notch 172 engages the prong 178, and the lock is prevented from rotating. FIG. 19 shows a split bushing 180 having a central aperture 182 with internal flats 184*a* and 184*b*, which are designed to engage the flats 132*a* and 132*b* on the barrel lock 130 shown in FIG. 12. In other embodiments, any suitable shaped means could be used to non-rotatably couple the bushing and the barrel lock.

CONCLUSION, RAMIFICATIONS, AND SCOPE OF THE INVENTION

The present invention provides a means for inducing the relative rotation of a barrel lock and key when the key is turned. This means comprises a sleeve rotatably mounted on the key. This sleeve non-rotatably couples the lock via complementary prongs and notches on the sleeve and the lock, respectively. The user can easily prevent the lock from rotating by holding the sleeve stationary when the key is turned. Because the notches are on the top of the lock, the present invention can be used even when the lock is encased on all sides by the locking hardware. Furthermore, the present invention does not prevent axial movement of the lock, and therefore allows removal of the lock from the locking hardware.

The present invention, therefore, is well adapted to carry out the objects and attain the ends and advantages mentioned, as well as others inherent therein. While, for purposes of disclosure, there have been shown and described what are considered at present to be the preferred embodiments of the present invention, it will be appreciated by those skilled in the art that other means may be used and changes may be made to the details of construction, combination of shape, size or arrangement of the parts or other characteristics without departing from the spirit and scope of the present invention. It is therefore desired that the present invention not be limited to these embodiments, and it is intended that the appended claims cover all such modifications as fall within the true spirit and scope of the present invention.

What is claimed is:

1. A key for operating a lock, said key comprising:

a sleeve having a first end, a second end, a central axis, an interlocking surface at said first end, and an axial bore extending therethrough, a shaft mounted in said bore in said sleeve, said shaft having first and second ends, said shaft being always rotatable relative to said sleeve, and a lock actuating portion rigidly attached to said first end of said shaft, said shaft being oriented in said bore such that sad lock actuating portion extends from said first end of said sleeve, said lock actuating portion being configured to actuate a barrel type lock upon rotation of said lock actuating portion about said central axis.

2. The key of claim 1, wherein said interlocking surface on said sleeve comprises one or more prongs extending axially from said sleeve.

3. The key of claim 1, wherein said interlocking surface on said sleeve comprises one or more notches extending axially into said sleeve.

4. The key of claim 1, further comprising a handle rigidly attached to said second end of said shaft, said handle extending from said second end of said sleeve.

5. The key of claim 1, wherein said sleeve is slidable axially along said shaft.

6. The key of claim 5, wherein:

said shaft further comprises a longitudinal slot therein;

said sleeve further comprises a circumferential groove in said axial bore; and said key further comprises a pin disposed transversely in said longitudinal slot and extending beyond said shaft into said circumferential groove, said pin cooperating with said slot and said groove to limit axial movement of said sleeve relative to said shaft while allowing free rotation of said sleeve relative to said shaft.

7. The key of claim 6, wherein:

said shaft further comprises a central bore; and said key further comprises:

a plug slidably mounted in said central bore, said plug having a transverse hole therein which receives said pin; and spring means disposed in said central bore, said spring means yieldingly urging said plug and biasing said sleeve towards said first end of said shaft.

8. A lock comprising:

an external case comprising a generally cylindrical head portion and a smaller diameter shank portion disposed at one end of said head portion, said head portion defining a central axis;

a key receiving face comprising a key receiving hole, an intermediate surface extending from said key receiving hole to the outermost extent of said key receiving face, and shaped means extending axially from said intermediate surface for receiving complementary shaped means on a key, said key receiving face defining the end of said head portion opposite said shank portion; and retaining means extensible from said shank portion of said external case upon rotation of said lock relative to a key about said central axis.

9. The lock of claim 8, wherein said shaped means comprises at least one notch extending axially into said face.

10. The lock of claim 8, wherein said shaped means comprises at least one prong extending axially from said face.

* * * * *